US006746166B1

(12) United States Patent
Jeon et al.

(10) Patent No.: US 6,746,166 B1
(45) Date of Patent: Jun. 8, 2004

(54) APPARATUS FOR CLEANING A SURFACE

(75) Inventors: Kee-Sook Jeon, Los Angeles, CA (US); Steven M. Montgomery, Los Angeles, CA (US)

(73) Assignee: Art Center College of Design, Pasadena, CA (US)

( * ) Notice: Subject to any disclaimer, the term of this patent is extended or adjusted under 35 U.S.C. 154(b) by 0 days.

(21) Appl. No.: 10/429,220

(22) Filed: May 2, 2003

(51) Int. Cl.[7] ..... A47L 13/26
(52) U.S. Cl. ..... 401/13; 401/279
(58) Field of Search ..... 401/13, 279, 278, 401/270, 286–288; 15/330

(56) References Cited

U.S. PATENT DOCUMENTS 1,268,271 A * 6/1918 Nelson ..... 401/13
1,393,133 A * 10/1921 Jarusz ..... 401/13
4,372,700 A * 2/1983 Moffitt, Jr. ..... 401/157

* cited by examiner

*Primary Examiner*—Gregory Huson
*Assistant Examiner*—Huyen Le
(74) *Attorney, Agent, or Firm*—The Hecker Law Group

(57) ABSTRACT

An apparatus for efficiently cleaning stains and extracting cleaning fluid from surfaces such as carpets and upholstery without requiring electrical power is presented. The invention eliminates the inconvenience of retrieving, filling with cleaning fluid, and plugging a deep cleaner into an electrical outlet in order to remove a small spot from a carpet. In addition to the scrubbing and fluid extracting capabilities, embodiments of the invention include a sprayer for applying cleaning fluid to stains. The sprayer may receive fluid from an attached refillable reservoir of cleaning solution, for example. During scrubbing, the top of a pump actuator provides resting place for the heel of a user's palm. The pump actuator may be locked down when scrubbing and unlocked for pumping to suck up fluid. A piston in a chamber provides the suction force for pulling fluid up through tubules, which may be interspersed between bristle tufts, past check valves and into a waste reservoir. A downward force on the piston provides the suction thereby assuring that the tubules are in contact with the surface during suction. The waste reservoir may be dumped via a plug in the waste reservoir.

21 Claims, 5 Drawing Sheets

APPARATUS FOR CLEANING A SURFACE

BACKGROUND OF INVENTION

1. Field of the Invention

This invention relates to cleaning devices, and more particularly to a device for cleaning and extracting fluids from carpets and other surfaces.

2. Background Art

There are instances when it is desirable to immediately grab a brush, some cleaning fluid, and rags to attempt to remove a stain before it sets and ruins floor coverings or furnishings. One such instance occurs in households where pets, children, and other pedestrian traffic tracks dirt into the house and grinds it into the carpet. Another such instance is when a soft drink or other colored fluid spills on house carpet, upholstery, or the interior of a car. These and similar cases often result in small spot stains, or stains in tight corners, that are difficult or inconvenient to clean using a conventional carpet and surface cleaning machines.

In small-spill cases, a user typically uses a scrub brush to scrub the soiled surface. Because scrub brushes typically don't spray cleaning fluid, and don't suck up dirty fluid, a spray bottle of cleaning fluid and some paper towels to remove the dirty fluid may also be needed. A typical cleaning procedure involves applying the cleaning fluid (for example by spraying the soiled area of carpet to saturation), scrubbing with the brush, and then using a towel or other absorbent material to attempt to extract the fluid from the surface. In some cases a user may use a wet-dry vacuum cleaner to remove the liquid from the carpet. However, using a wet-dry vacuum cleaner adds another cumbersome and inconvenient item to the cleaning tools needed. Thus, the user may need a scrub brush, cleaning fluid spray bottle, and wet-dry vacuum cleaner just to remove a small stain.

Other methods of removing stains include renting or buying a bulky carpet-cleaning machine, contracting with a carpet and upholstery cleaning company, or engaging an automobile detailer (for stains in automobile carpeting or upholstery). Moreover, prior art cleaning machines require electrical power to operate.

Thus, there is need for a compact and inexpensive device for cleaning stains on carpets, upholstery and other surfaces and for extracting cleaning and other fluids from those surfaces.

SUMMARY OF INVENTION

Figure 1:
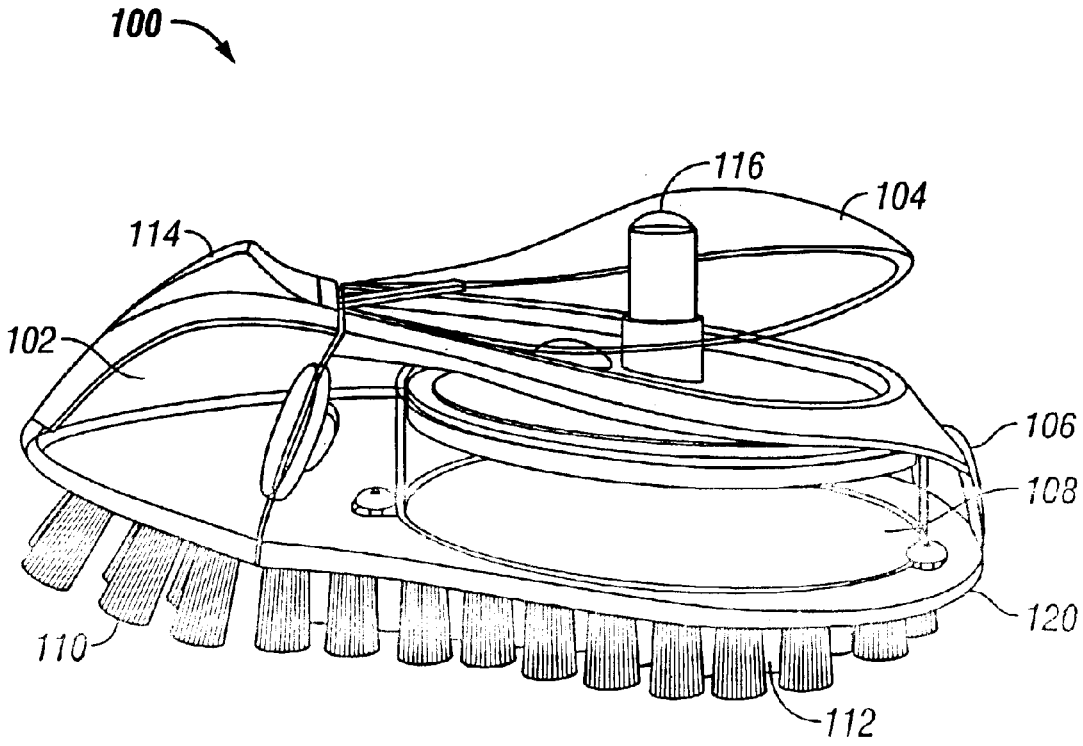
FIG. 1 is an illustration of a scrubber in accordance with an embodiment of the present invention.

The present invention is directed at an apparatus for cleaning stains and extracting fluids from carpets, upholstery, and other surfaces. The present invention is particularly suited for cleaning small spots such may be found, for example, in households where pets and children track dirt into the house and grind the dirt into the carpet.

The present invention provides a compact and inexpensive device that does the work that in the prior art would have to be performed by a combination of scrub brush, cleaning solution, spray bottle, and absorbent rags, or a cumbersome deep cleaner. The present invention provides a device that is compact and storable in a drawer near a likely-spill or dirt track-in area and incorporates all the tools needed for cleaning small spots. Cleaning solution is on-board and is refilled as needed.

Embodiments of the present invention allow the large joints and muscles of the upper body to engage in both scrubbing and fluid extraction. In one embodiment, fluid extraction is accomplished by exerting a downward, pumping action on the device. The pumping can be done vigorously and rapidly because the user can lean directly down on the pump actuator.

One embodiment of the present invention includes a spraying scrub brush that includes a reservoir for cleaning solution within the brush. To scrub, a user first saturates the soiled area with the built-in cleaning solution sprayer. The user then scrubs using the built-in bristle brush.

One or more embodiments of the invention provide a suction mechanism for extracting moisture from a surface after scrubbing. The suction mechanism is built into the spraying scrub brush and may be used without the scrubbing feature. For instance, it may be used to simply suck up fluid from a tile floor. In one embodiment, the sucking feature is activated by a vacuum generated by downward motion (during pumping) of a user's hand on a pump actuator located on top of the unit. The vacuum draws fluid up into a collection chamber/reservoir. An exhaust mechanism that releases air from the collection chamber is activated by the upward motion of the user's hand. This pumping action (downward during suction and upward during exhaust) assures that the scrub brush is in contact with the wet surface during the suction stroke.

In one embodiment, the downward stroke on the scrub brush handle drives a rod coupled to a spring-loaded piston in a cylinder to create the desired suction. On the downward stroke, waste fluid is sucked up through multiple tubules (or suction fingers) that extend downward from the bottom of the scrub brush. The protruding tubules are pressed onto the wet surface during the downward stroke, and fluid is sucked up through the tubules into a plenum under the floor of the reservoir. The sucked-up fluid passes up into the reservoir through check valves (e.g. rubber check valves), and is contained in the reservoir. On the up-stroke a second check valve opens at the top of the reservoir, allowing air to escape the reservoir. This top check valve closes on the subsequent down-stroke, allowing a vacuum to be created in the reservoir by the downward movement of the piston, and the suction cycle starts again.

The user may repeat the pumping action until all the fluid is collected or the reservoir is full. For embodiments having transparent collection chambers, the amount of fluid in the reservoir is apparent by visual inspection. Alternatively, a chamber full indication may be provided to the user using a visual or audible indication (e.g., sound, light, etc). The user may drain the collection chamber through a drainage port.

DETAILED DESCRIPTION

The present invention comprises a method and apparatus for cleaning and extracting fluids from carpets, floors, upholstery and other surfaces. In the following description, numerous specific details are set forth to provide a more thorough description of embodiments of the invention. It will be apparent, however, to one skilled in the art that the invention may be practiced without these specific details. In other instances, well known features have not been described in detail so as not to obscure the invention.

In one embodiment, the present invention comprises an apparatus for scrubbing, applying cleaning fluid, and extracting fluid from carpets, upholstery and other surfaces without the need for electrical power. Many small stains are inconvenient to clean using a conventional carpet and surface cleaning machines. The present invention provides a convenient and compact device for removing stains without the inconvenience of carrying a heavy carpet or other surface cleaning machine to the location of stain and without the necessity for an electrical power outlet. For instance, embodiments of the invention are useable for quickly removing dirt which may have been tracked into a house and ground into a carpet by dogs, children or other pedestrian traffic.

In the prior art, to perform some of the functions of the present invention, either a handful of tools and materials (a rag, carpet cleaning solution, spray bottle, scrub brush, and dry rags to absorb moisture) or a bulky, electrically powered carpet or other surface cleaning machine was required. However, deployment of a carpet cleaning machine is a relatively major operation and the cost and inconvenience may not be justified for a small spot stain.

In contrast, the present invention may conveniently be used for both small spots and large spots. For instance, an embodiment includes a sprayer for applying cleaning fluid to stains, brush bristles for scrubbing, and a fluid extraction mechanism for removing fluids from the surface.

In one embodiment, the sprayer receives fluid from an attached refillable reservoir of cleaning solution. A standard trigger or pump action mechanism is used to spray the solution onto the desired surface. In one or more embodiments, the fluid extraction mechanism is activated through a pump actuator on top of the device. The pump actuator provides resting place for the heel of a user's palm. The pump actuator may be locked down when scrubbing and unlocked (allowing pumping) for extracting the fluid.

In one embodiment, the actuator drives a piston in a chamber to create suction, pulling fluid up through tubules that are interspersed between bristle tufts extending from the bottom surface of the scrubber. The fluid is drawn through the tubules, past one or more check valves and into a waste reservoir. The waste reservoir can be drained via a removable plug.

In one embodiment, downward motion of the user's hand on the pump actuator generates a vacuum in a collection chamber causing fluid to be sucked up into the collection chamber. Upward motion of the user's hand, in turn, activates an exhaust mechanism that allows air to be released from the collection chamber. The downward pressure on the pump actuator on the suction stroke assures that the scrubber is pressing firmly onto the wet surface on each suction stroke.

In one embodiment, the downward stroke on the scrub brush handle drives a rod that is coupled to a spring-loaded piston in a cylinder to create the desired suction. On the downward stroke, waste fluid is sucked up through multiple tubules (or suction fingers) that extend downward from the bottom of the scrub brush. The protruding tubules are pressed onto the wet surface during the downward stroke, and fluid is sucked up through the tubules into a plenum under the floor of the reservoir. The sucked-up fluid passes up into the reservoir through check valves (e.g. one-way rubber check valves), and is contained in the reservoir. On the up-stroke a second check valve opens at the top of the reservoir, allowing air to escape the reservoir. This top check valve closes on the subsequent down-stroke, allowing a vacuum to be created in the reservoir by the downward movement of the piston, and the suction cycle starts again.

A detailed description of an,embodiment of the scrubber of the present invention follows. Referring to FIG. 1, scrubber 100 comprises a base 120. Base 120 may have a variety of configurations and sizes, depending, for example, on the intended use of scrubber 100. In one embodiment, scrubber 100 is configured as a handheld device for cleaning small spots on carpets and other surfaces, and base 120 is shaped to fit in the palm of an average adult's hand. Other embodiments include, for example, a step-on pump configuration, upright trigger grip configuration, and two-handed configurations. Thus the size and shape of scrubber 100 and base 120 may depend on a number of ergonomic, design, and other considerations.

Figure 5:
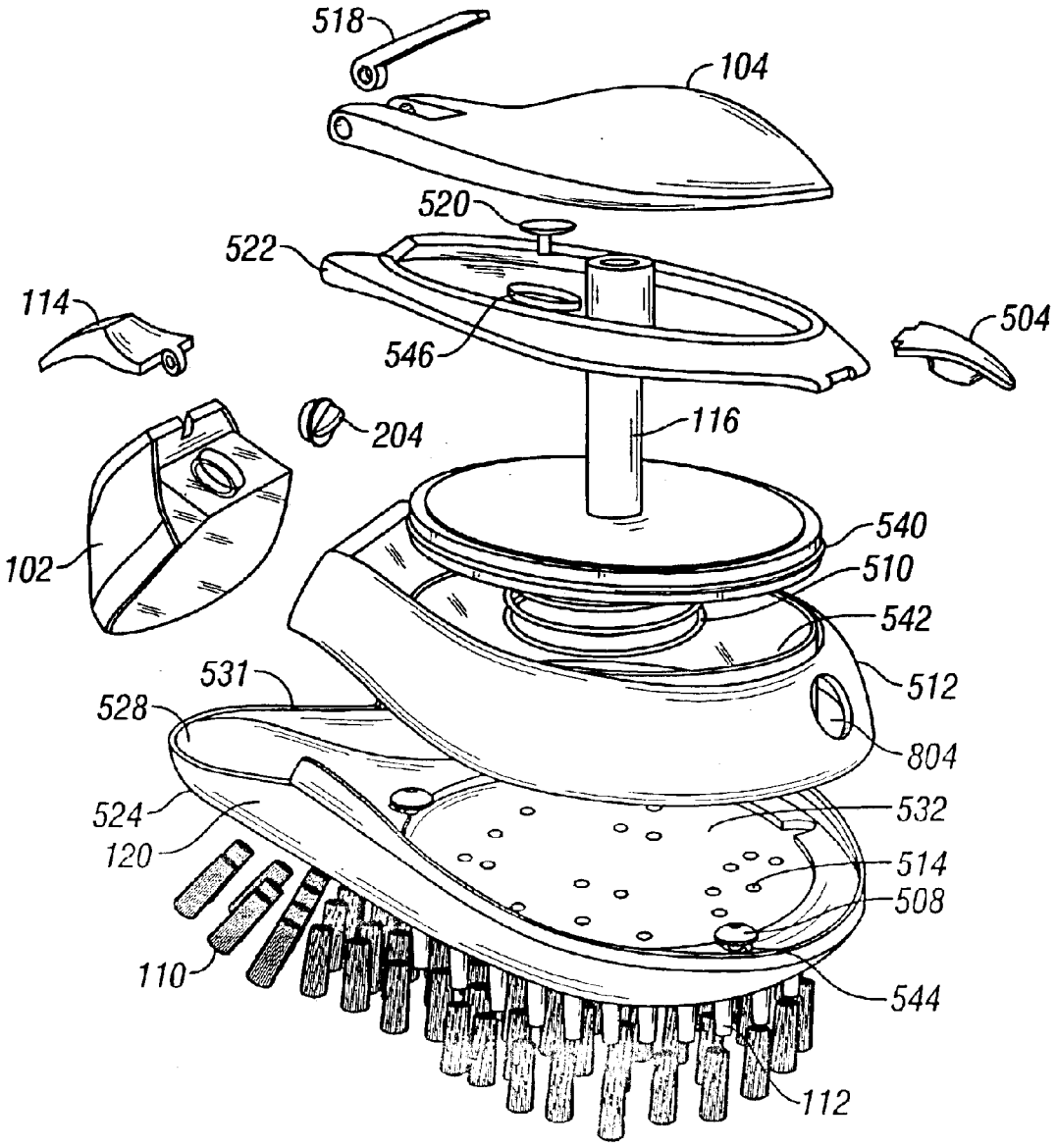
FIG. 5 is an illustration of the breakdown of major components of the scrubber of FIG. 1 in accordance with an embodiment of the present invention.

An embodiment of the scrubber of the present invention is further illustrated in FIG. 5. In the embodiment of FIG. 5, base 120 has a top face 528 and an opposing bottom face 524. Base 120 has generally a front part 531 and a rear part 532. Base 120 may be made of any suitable material such as, for example, injection-molded plastic. Base 120 further comprises at least one suction hole 514 located in the rear part 532 that extends from top face 528 through to bottom face 524. The diameter of each of suction hole 514 may be determined by the density of fluid intended to pass through, the total number of holes, the amount of suction that will be applied, and other factors. For example, suction hole 514 may be sized to allow the suction of spilled liquid such as milk or cleaning fluid without excessive force being applied to the suction mechanism.

In one embodiment, a plurality of holes 514 is spread uniformly over rear end 532. Each of the plurality of holes 514 is sized to hold a suction finger 112. Suction finger 112 may be a tubule with an outside diameter and an inner diameter. The effective inner diameter of suction finger 112 is large enough to allow suction of spilled household fluids and cleaning fluids from a variety of household surfaces, including carpets and upholstery. The effective outer diameter of suction finger 112 is larger than the inner diameter and may depend on various considerations. For instance, the effective outside diameter may be just large enough to fit into and maintain a solid grip within suction hole 514.

In other embodiments, suction hole 514 and the inner diameter of suction finger 112 are approximately equal. Outside diameter of suction finger 112 may be just large enough to cover suction hole 514, provide enough elastic strength to hold scrubber 100 upright during pumping action, and for attaching to bottom face 524 of base 120. Suction finger 112 may be attached to bottom face 519 with adhesive or by other suitable attachment means. Alternatively, suction fingers 112 may be integrally molded with bottom face 524 of base 120 or with the bottom of collection tank 108 (see FIG. 1). In other embodiments, suction fingers 112 may be made of elastomer or other flexible or resilient materials.

Figure 6A:
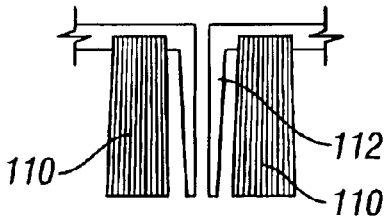
FIGS. 6A and 6B are illustrations of two suction finger configurations in accordance with embodiments of the present invention.
Figure 6B:
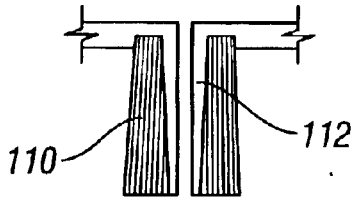

In one or more embodiments of the invention, a plurality of bristle tufts 110 are attached to front end 531 of bottom face 524 of Base 120. Bristle tufts 110 may also be distributed among the suction fingers 112 at bottom face 524 of back end 532 of base 120. Bristle tufts 110 may be made from nylon or other natural or man-made materials suitable for scrub brushes. In one embodiment, bristle tufts 110 may be evenly distributed at front end 531 and rear end 532 of bottom face 524. Bristle tufts 110 may be arranged in a plurality of compact groups, each compact group comprising a plurality of bristle brush materials. Bristle tufts 110 may be interwoven with suction fingers 112. For instance, a plurality of bristle tufts 110 may be arranged adjacent to suction finger 112, as illustrated in FIG. 6A. In another embodiment, a suction finger 112 may be radially located within a bristle tuft 110, as illustrated in FIG. 6B.

Referring to the embodiment of FIGS. 1 and 5, a solution tank 102 is detachably coupled to front end 531 of top face 524 of base 120. In one embodiment, solution tank 102 comprises a fluid reservoir for holding cleaning fluid. A spray mechanism 114 is attached to the top side of solution tank 102. Spray holes (not shown) are positioned strategically in the front side of solution tank 102 so as to provide efficient dispensing of cleaning fluid to the desired spot when spray mechanism 114 is activated. Spray mechanism 114 may comprise a push button type mechanism, a trigger type mechanism, or any other conventional mechanism dispensing cleaning fluid to specific areas.

In the embodiments of FIGS. 1 and 5, scrubber 100 further comprises a collection tank 108. Collection tank 108 has an open bottom face. The bottom face of collection tank 108 is mated to rear end 532 of top face 528 of base 120. Collection tank 108 is positioned so as to encompass suction holes 514, adjacent to solution tank 102. Collection tank 108 may also provide a base for attachment of solution tank 102.

Collection tank 108 comprises a plurality of check valves 508, spring 510, and plunger 116. Plunger 116 comprises a cylindrical shaft and a thin, flat piston 540 that extend out from the top end of collection tank 108. Collection tank 108 may also include a sealable drain hole 704 (FIG. 7) for disposing of fluid that has accumulated in collection tank 108. Drain cover 106 may be movably coupled to collection tank 108 adjacent to drain hole 704 to allow drain hole 704 to be opened and resealed.

In the embodiment of FIG. 5, scrubber 100 further comprises a top plate 522 positioned above and coupled to the top of collection tank 108, forming a seal around the top edge of collection tank 108 and securing plunger 116 and spring 510 in place within collection tank 108. Top plate 522 comprises an orifice through which the shaft of plunger 116 protrudes, and at least onehole 546 to which check valve 520 is mounted. Top plate 522 further includes a front end which may be located approximately at the intersection between solution tank 102 and collection tank 108. Top plate 522 may also provide attachment points for solution tank 102 and pump actuator 104.

Scrubber 100 further comprises pump actuator 104 movably attached to the front of top plate 522. Pump actuator 104 has a top side and a bottom side, and operates in an open and a closed position. Pump actuator 104 may be shaped so that in its closed position, pump actuator 104 lies flush against top plate 522. In one embodiment, bottom side of pump actuator 104 is always in contact with plunger 116. Lever 518 locks pump 104 in its closed position during scrubbing operation.

Scrubber 100 further includes piston cylinder 542. Piston cylinder 542 houses spring 510 and piston 540. Piston cylinder 542 resides within collection tank 108, and may be integrally formed with collection tank 108. The outer peripheral casing of collection tank 108 is housing 512. A plurality of check valves 508 reside at ports 544 which are located in base 120 adjacent to the annular region formed between piston tank 542 and housing 512.

Figure 2:
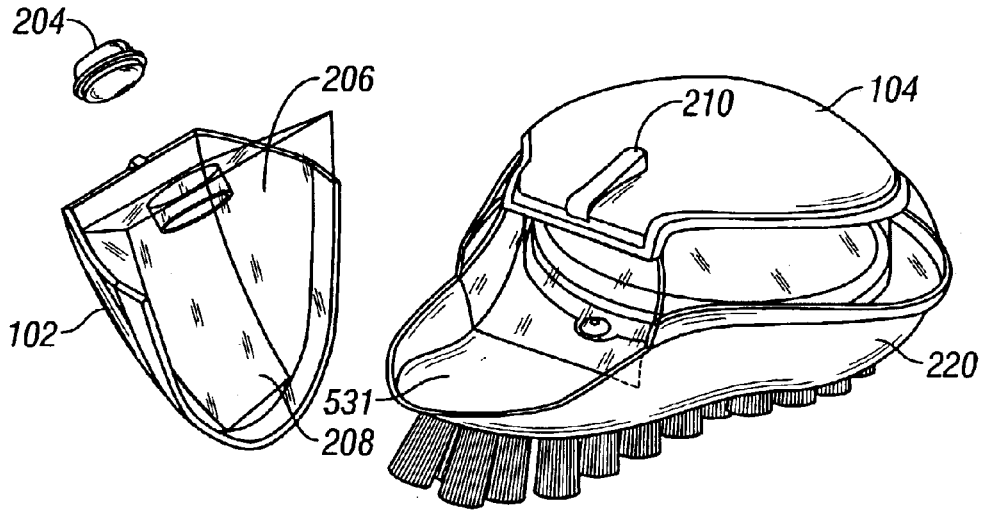
FIG. 2 is an illustration of the scrubber of FIG. 1 with the solution tank detached.

FIG. 2 is an illustration of scrubber 100 of FIGS. 1 and 5 with solution tank 102 detached. As illustrated in FIG. 2, one embodiment of solution tank 102 includes fluid refill port 206 and cover 204. Cover 204 attaches to fluid refill port 206 to provide sealing and prevent leakage of cleaning fluid from solution tank 102. The bottom side 208 of solution tank 102 is attachable to front end 531 of base 120. In other embodiments, base 120 may include spray holes at front end 531 so that cleaning fluid may be dispensed out of bottom face 524 of base 120. In such a configuration, solution tank 102 may include dispensing holes at the bottom, or could be integrally formed with front end 531 of Base 120.

Additionally, latch 210 may be used to secure pump actuator 104. In operation, latch 210 may operate to lock or unlock pump actuator 104 by pressing on its top, for example. Other embodiments of latch 210 may be used. The purpose of latch 210 is to secure pump actuator 104 during scrubbing operation, for example. It may also be inconveniencing in some embodiments to scrub with pump actuator 104 in the open position.

Figure 3:
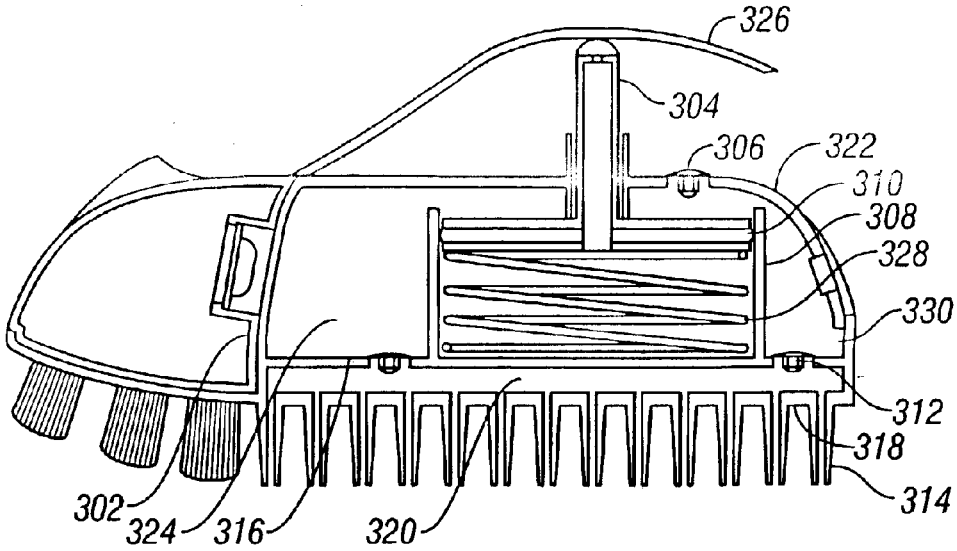
FIG. 3 is an illustration of a cross sectional view of the scrubber with emphasis on the collection tank in accordance with an embodiment of the present invention.

FIG. 3 is an illustration of a cross sectional view of the scrubber with emphasis on the collection tank in accordance with an embodiment of the present invention. As illustrated, scrubber 100 comprises one or more fluid intake check valves 312, one or more air release check valve 306, plunger 304, piston and ring 310, inner cylinder (piston chamber) 308 and collection tank 302. Piston chamber 308 fits entirely into collection tank 302 leaving space 324 for collection of waste fluid. Piston chamber 308 is shorter than collection tank 302 thus leaving air space between top plate 322 and the top of cylinder 308. The walls of collection tank 302 are preferably made of clear plastic.

Collection tank 302 has a bottom plate 318, a middle plate 316, and a top plate 322. The middle plate (i.e., 316) separates waste collection chamber 324 from plenum chamber 320. In one embodiment, middle plate 316 is a ring with a slot wherein piston chamber 308 snuggly fits. Middle plate 316 could also be one continuous plate with piston chamber 308 fitting integrally on top. Other configurations of middle plate 316 are possible so long as the chosen configuration provides the desired functionality. Bottom plate 318 has a top face, a bottom face, and a plurality of suction holes to which a plurality of suction fingers 314 is coupled. Each of suction fingers 314 has a hole extending from the bottom of the suction finger through to the top of the suction finger. The top of each suction finger is coupled to or integrated with the bottom face of bottom plate 318.

Middle plate 316 has a top face, a bottom face, and is located substantially parallel to bottom plate 318 and so that its bottom face is above the top face of bottom plate 318 thus providing a plenum chamber 320 between middle plate 316 and bottom plate 318. Piston chamber 308 attaches at its bottom to the top face of middle plate 316 and extends upwards towards the bottom face of top plate 322 without contacting the bottom surface of top plate 322. Thus there exists an air gap between the top of inner cylinder 308 and the bottom of top plate 322. Top plate 322 is coupled to the top of collection tank 302. Top plate 322 further includes a plurality of holes, one for connecting plunger 304 from where it makes contact with pump 326 on the outside of collection tank 302 to piston 310 inside piston chamber 308. Other holes in top plate 322 may be used for air release check valve 306.

One or more fluid intake check valves 312 are located through middle plate 316 between the outer wall of the inner cylinder 308 and the inner wall of the collection tank 302. Each check valve 312 is positioned to allow for fluid flow into chamber 324 from chamber 320. Chamber 320 may be exposed to ambient pressure through the holes in suction fingers 314.

Located within the top plate 322 are one or more check valves 306 coupled to release air to the atmosphere. Also within the top plate 322 is a guide hole for plunger 304. At the bottom of plunger 304 is a piston and ring assembly 310 which is located inside the inner cylinder 308. At rest, the bottom of piston 310 may be positioned away from middle plate 316. For instance, a spring or like device (i.e., 328) may be used to position piston 310 away from the top face of middle plate 316. Operation of the collection tank assembly is discussed with the illustrations of FIGS. 4A through 4C.

Figure 4A:
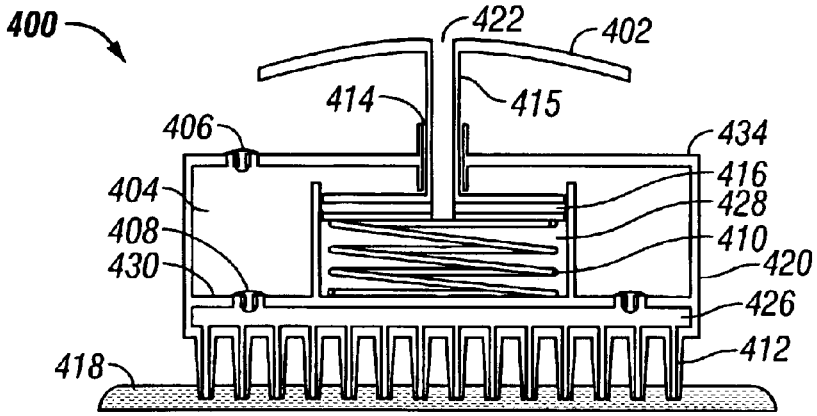
FIGS. 4A–4C are illustrations showing the principles of a fluid suction mechanism of the scrubber of FIG. 1 in accordance with an embodiment of the present invention.
Figure 4B:
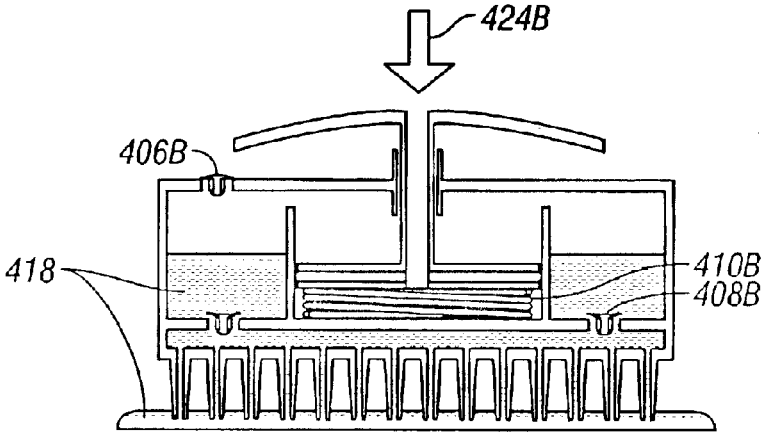
Figure 4C:
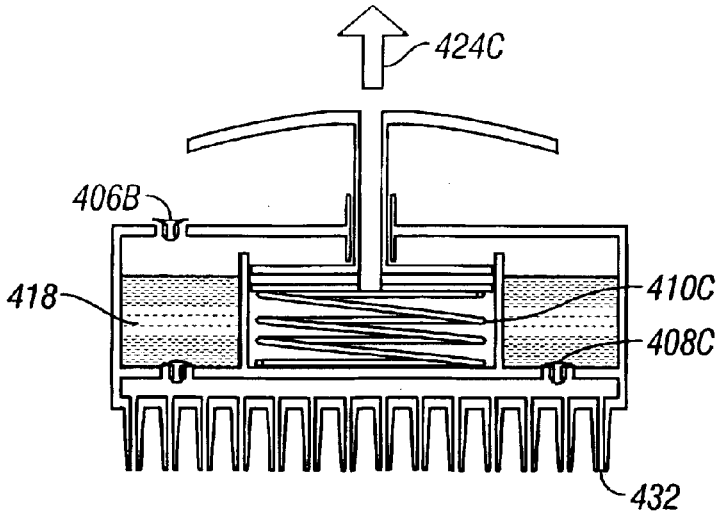

FIGS. 4A–4C are illustrations showing the principles of the fluid suction mechanism of the scrubber in accordance with an embodiment of the present invention. As illustrated in FIG. 4A, the suction mechanism comprises collection tank 420, suction fingers 412, pump 402, plunger 415, piston and ring 416, piston chamber 428, ventilation check valves 406, fluid check valves 408, spring 410, and vacuum chamber 404. FIGS. 4A–4C illustrate how the scrubber of the present invention sucks up fluid 418 from a surface such as a carpet Referring to FIG. 4A, Collection tank 420 comprises a lower chamber 426 and a collection chamber 404, located above lower chamber 426. The chambers are separated by a plate 430 having one or more check valves 408. Fluid transfers in one direction from lower chamber 426 to collection chamber 404 through check valves 408. The fluid enters the lower chamber through suction holes 432 (see FIG. 4C), which extends from suction finger 412 into lower chamber 426. Suction fingers 412 are tubules coupled to the outside and bottom end of lower chamber 426.

Collection chamber 404 includes a top cover 434 and check valves 406 in the top cover. Check valve 406 provides escape for air out of collection chamber 404. Collection tank 420 further comprises a piston chamber 428 which houses a piston 416 and spring 410. Piston chamber 428 is a cylindrical container with an outer diameter smaller than the inner diameter of collection chamber 404 thus providing a reservoir 404 for fluid. Piston chamber 428 is coupled at its bottom end to the middle plate 430. The length of piston chamber 428 is such that there is space between its top end and the bottom of top plate 434. Spring 410 is located inside piston chamber 428 between middle plate 430 and piston 416. Coupled to piston 416 is a piston rod (or plunger) 415 which extends upwards, out of collection tank 420, through opening 414 in top plate 434, and coupled at the outside to pump 402.

The piston rod 415 has a hollow opening 422, permitting the area within its cylinder (i.e., piston chamber 428) to maintain atmospheric pressure. The pressure in collection chamber 404 is regulated through vacuum control of check valves 406 and 408.

In the illustration of FIG. 4A, fluid 418 is on the floor and needs to be sucked up in order for the floor to dry. The scrubber 400 is placed so as to make contact with fluid 418, as shown, while pressure is applied to piston 416 through pump 402. The applied pressure (or force) is a downward force illustrated with arrow 424B in FIG. 4B. Referring to FIG. 4B, as downward pressure 424B is applied at pump 402, piston and ring 416 moves downward thereby decreasing size of piston chamber 428 and increasing the vacuum (thus decreasing pressure) in collection chamber 404. This downward force causes air in piston chamber 428 to escape through opening 422 in the plunger 415. Note that piston chamber 428 remains at atmospheric pressure. In embodiments that include spring 410, energy is stored in spring 410 as it compresses due to the downward force.

This decrease in pressure inside collection chamber 404, which is caused by the downward pressure on the pump actuator, forces check valves 408 to open thereby creating a suction effect through suction fingers 412. The suction effect draws fluid from the outside into collection chamber 404 in attempts to balance tie pressures between the collection chamber and the outside. And as a result of the suction effect, some quantity of fluid 418 passes from the outside, through suction fingers 412, through lower chamber 426, and into chamber 404 to balance the pressure differential created by the downward force 424B applied on pump 402.

At the next stroke, an upward force 424C is applied to piston 416. See FIG. 4C. For instance, in embodiments that implement a spring type mechanism, the upward force may be applied by the stored energy in spring 410. Those of skill in the arts will recognize that other means may be used to apply upward force to piston 416. For example, other means may be employed that apply mechanical force at pump 402 causing piston 416 to move upwards.

As piston 416 moves upwards, air flows into piston chamber 428 through orifice 422, ventilation check valve 406 opens, and check valves 408 closes. The opening of ventilation check valve 406 provides means for air to escape from collection chamber 404 thereby equalizing the pressure between chamber 404 and the outside. In addition, the closing of fluid check valves 408 prevents the part of fluid 418 that has been collected in collection chamber 404 from escaping through fluid check valves 408 and back to the floor. This cycle of downward pressure and upward pressure may continue until complete transfer of fluid 418 from the floor into collection tank 404.

Figure 7:
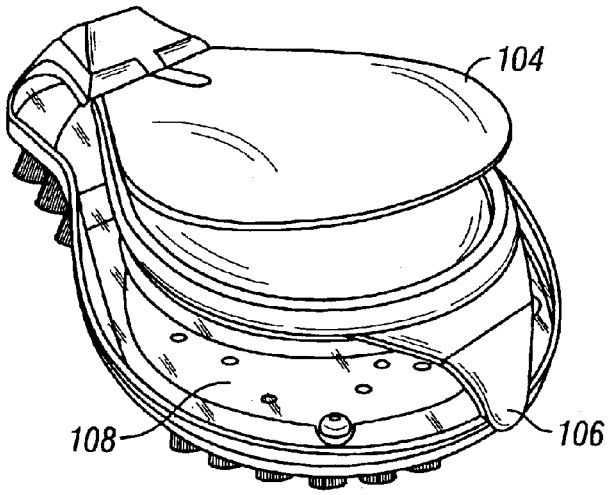
FIG. 7 is an illustration of an embodiment of the present invention showing a fluid drainage port in a closed position.
Figure 8:
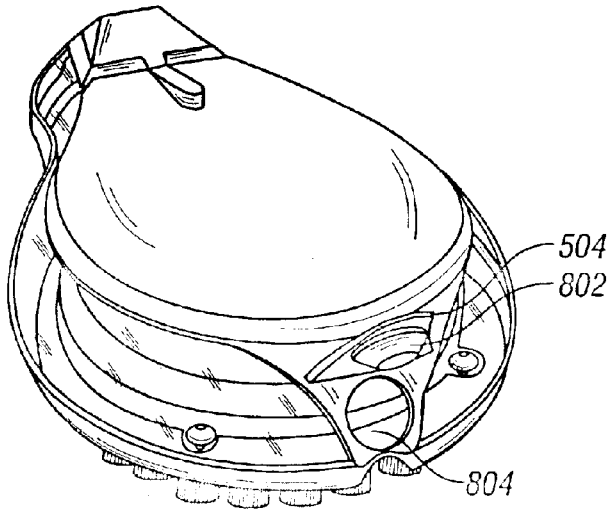
FIG. 8 is an illustration of an embodiment of the present invention showing a fluid drainage port in an open position.

After transfer of fluid 418 into collection chamber 404 is complete, there is a need to drain the fluid from the collection chamber when the chamber fills up. FIG. 7 is an illustration of an embodiment of the present invention showing fluid drainage port 106 in a closed position. In this illustration, the fluid drainage is located at the back end of the scrubber. Fluid drainage port 106 is located in the collection tank such as to permit complete drainage of the accumulated fluid. FIG. 8 is an illustration of the drainage port in an open position.

The drainage cover 504 comprises drainage plug 802. Drainage plug 802 may be made from material such as rubber that will seal the drainage opening, which is located at the side wall of the collection chamber, to prevent loss of pressure in the collection chamber. Drainage port 804 may be large enough to facilitate easy drainage and cleaning (e.g., rinsing) of the collection chamber.

Figure 9:
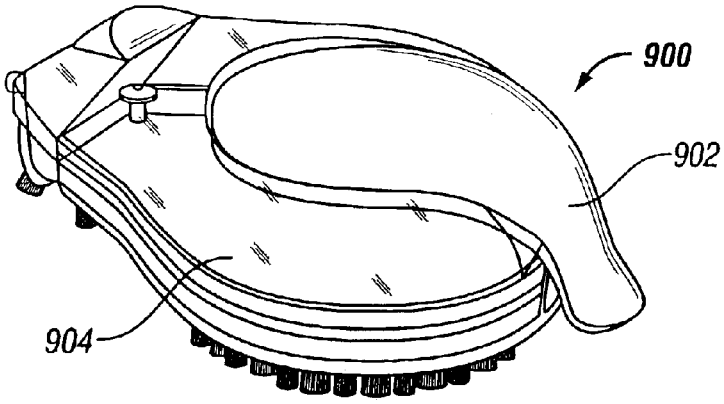
FIG. 9 is an illustration of the scrubber of FIG. 1 with a different configuration pump actuator in accordance with an embodiment of the present invention.

FIG. 9 is an illustration of another embodiment of the present invention using a different configuration pump actuator. In this illustration, pump actuator 902 is a slot type pump. The pump 902 is pivoted towards the rear of scrubber 900 and is designed to integrate with top plate 904. In this configuration, downward pumping force results in the pump actuator being below the surface of the top cover. Thus a latching mechanism to hold the pump in place for scrubbing may not be necessary. This is unlike the embodiment of FIG. 1 wherein the pump actuator needed to be latched before scrubbing.

Invention Operation

To use the scrubber, a user first saturates the soiled area with the built-in cleaning solution sprayer 114. The user then scrubs using the bristle brush (e.g., 110) to loosen the stain. After scrubbing, the user employs the sucking feature of the invention by pumping, via the scrubber's pump actuator, to suck the bulk of the moisture out of the cleaned area. Note that it is not necessary to scrub before using the sucking feature. For instance, the sucking feature may be used to suck-up liquid from surfaces even when there is no need to scrub.

The user repeats the pumping action until either fluid is no longer filling the collection chamber, which can be seen if the collection chamber is transparent, or a chamber full indication provided to the user using some type of tactile feedback (e.g., sound, light, etc). The user then drains the collection chamber through the drainage port which may be located in the rear of the unit.

The ergonomic shape of a handheld scrubber allows the large joints and muscles of the upper body to engage in both scrubbing and pumping. The pumping can be done vigorously and rapidly as the user can lean directly down on the pump actuator.

The scrubber is compact and inexpensive and would do the work that is too burdensome for a deep cleaner. Scrub brushes typically don't spray, and don't suck up dirty fluid therefore doing the job with a scrub brush requires a sprayer and possibly a wet-dry vacuum to the same work as the present invention. Wet-dry vacuum cleaners can remove liquid, but can neither spray cleaning fluid nor scrub. The scrubber of the present invention provides all these capabilities in a compact device which is storable in a drawer near a likely-spill or dirt track-in area. Cleaning solution is on-board and is refilled as needed.

Thus, a method and apparatus for efficiently cleaning stains and extracting cleaning fluid from a surface have been described. Particular embodiments described herein are illustrative only and should not limit the present invention thereby. The invention is defined by the claims and their full scope of equivalents.

What is claimed is:

1. An apparatus for cleaning a surface comprising:

a collection tank having a first chamber and a second chamber, said first chamber and said second chamber having a top end and a bottom end;

at least one first check valves connecting said first chamber and said second chamber such that a first fluid flows between said second chamber and said first chamber;

at least one second check valves located at said top end of said first chamber such that a second fluid flows between inside of said first chamber and outside of said first chamber; and a piston chamber within said first chamber, said piston chamber having a piston located within, a rod coupled at a first end to said piston and at a second end to a pump handle located outside of said first chamber, said piston being movable in a first direction and a second direction within said piston chamber by actuation of said pump handle.

2. The apparatus of claim 1, wherein moving said piston in said first direction creates a vacuum in said first chamber thus closing said second check valves and opening said first check valves thereby causing said first fluid to flow from said second chamber to said first chamber.

3. The apparatus of claim 1, wherein moving said piston in said second direction causes partial evacuation of said second fluid from said first chamber to said outside of said first chamber by opening said second check valves and closing said first check valves.

4. The apparatus of claim 1, wherein said second chamber has at least one suction hole at said bottom end of said second chamber for, obtaining said first fluid.

5. The apparatus of claim 4, further comprising:

a suction finger coupled to each of said at least one suction hole, wherein said suction finger extends said suction hole to outside of said second chamber.

6. The apparatus of claim 5, wherein moving said piston in said first direction causes said suction fingers to be in substantial contact with any of said first fluid residing outside of said second chamber thereby causing said first fluid to flow through said suction fingers and through said second chamber to said first chamber.

7. The apparatus of claim 5, further comprising:

a plurality of bristle brush materials at said bottom end of said second chamber.

8. The apparatus of claim 1, further comprising:

a fluid sprayer coupled to said collection tank, said fluid sprayer having a refillable reservoir.

9. The apparatus of claim 1, wherein said collection tank further comprises a drainage port for cleaning said collection tank.

10. The apparatus of claim 1, wherein said first fluid flows in one direction from said second chamber to said first chamber.

11. The apparatus of claim 1, wherein said second fluid flows in one direction from inside of said first chamber to outside of said first chamber.

12. An apparatus for cleaning a surface comprising:

a collection tank having a first chamber and a second chamber, said first chamber and said second chamber having a top end and a bottom end;

at least one first check valves connecting said first chamber and said second chamber at said bottom of said first chamber and said top of said second chamber;

at least one second check valves located at said top end of said first chamber such that a second fluid flows between inside of said first chamber and outside of said first chamber; and a piston chamber within said first chamber, said piston chamber comprising a piston and a and a rod coupled at a first end to said piston and at a second end to a pump located outside said first chamber, said rod having a hollow opening from outside said first chamber into said piston chamber thereby maintaining pressure of said outside of said first chamber within said piston chamber, said piston being movable in a first direction and a second direction within said piston chamber by actuation of said pump, wherein vacuum is created when said piston is moved in said first direction causing said first fluid to flow between said second chamber and said first chamber, and said second fluid flows between said first chamber and said outside of said first chamber when said piston is moved in said second direction.

13. An apparatus for cleaning a surface comprising:

a collection tank having a first chamber and a second chamber, said first chamber and said second chamber having a top end and a bottom end;

at least one first check valves connecting said first chamber and said second chamber such that a first fluid flows in one direction from said second chamber to said first chamber;

at least one second check valves located at said top end of said first chamber such that a second fluid flows in one direction from inside of said first chamber to outside of said first chamber; and a cylindrical piston chamber within said first chamber, said piston chamber having a piston located within and a rod coupled at a first end to said piston and at a second end to a pump located outside said top end of said first chamber, said rod having a hollow opening from outside said first chamber into said piston chamber thereby maintaining pressure of said outside of said first chamber within said piston chamber, said piston being movable in a first direction and a second direction within said piston chamber by actuation of said pump, wherein vacuum is created when said piston is moved in said first direction causing said first fluid to flow from said second chamber tosaid first chamber, and wherein said second fluid flows from said first chamber to said outside of said first chamber when said piston is moved in said second direction.

14. An apparatus for cleaning a surface comprising:

a collection tank having a top end and a bottom end;

at least one first check valves located at said bottom end of said collection tank, said first check valves capable of passing a first fluid, said first check valves connecting inside of said collection tank at said bottom end through a first set of suction openings to outside of said collection tank;

at least one second check valves located at said top end of said collection tank, said second check valves capable of passing a second fluid between inside of said collection tank and outside of said collection tank; and a piston chamber within said collection tank, said piston chamber comprising a piston located inside of said piston chamber and a rod coupled at a first end to said piston and at a second end to a pump located outside of said collection tank, said piston being movable in a first direction and a second direction within said piston chamber by actuation of said pump.

15. The apparatus of claim 14, wherein moving said piston in said first direction creates a vacuum in said collection tank thus closing said second check valves and opening said first check valves thereby causing said first fluid to flow from said outside of said collection tank to said inside of said collection valve.

16. The apparatus of claim 14, wherein moving said piston in said second direction causes partial evacuation of said second fluid from said collection tank to said outside of said collection by opening said second check valves and closing said first check valves.

17. The apparatus of claim 14, further comprising:

a suction finger coupled to each of said at least one suction hole, wherein said suction finger extends said suction hole to outside of said second chamber.

18. The apparatus of claim 17, wherein moving said piston in said first direction causes said suction fingers to be in substantial contact with any of said first fluid residing outside of said collection tank thereby causing said first fluid to flow through said suction fingers and into said collection tank.

19. The apparatus of claim 17, further comprising:

a plurality of bristle brush materials at said bottom end of said collection tank.

20. The apparatus of claim 14, further comprising:

a fluid sprayer coupled to said collection tank, said fluid sprayer having a refillable reservoir.

21. The apparatus of claim 14, wherein said collection tank further comprises a drainage port for cleaning said collection tank.

* * * * *